US006324979B1

(12) United States Patent
Troianello

(10) Patent No.: US 6,324,979 B1
(45) Date of Patent: Dec. 4, 2001

(54) ELECTRO-PYROTECHNIC INITIATOR

(75) Inventor: Anthony E. Troianello, Santa Ana, CA (US)

(73) Assignee: Vishay Intertechnology, Inc., Malvern, PA (US)

( * ) Notice: Subject to any disclaimer, the term of this patent is extended or adjusted under 35 U.S.C. 154(b) by 0 days.

(21) Appl. No.: 09/466,939

(22) Filed: Dec. 20, 1999

(51) Int. Cl.[7] ..... F42B 3/12
(52) U.S. Cl. ..... 102/202.7
(58) Field of Search ..... 102/202.5, 202.4, 102/215, 202.8, 202.7, 202.9, 202.1; 315/209

(56) References Cited

U.S. PATENT DOCUMENTS

| | | | |
|---|---|---|---|
| 3,366,055 | | 1/1968 | Hollander, Jr. . |
| 3,447,416 | | 6/1969 | Apstein . |
| 3,779,167 | | 12/1973 | Irish, Jr. et al. . |
| 4,572,288 | * | 2/1986 | Kinley . |
| 4,696,851 | * | 9/1987 | Pryor . |
| 4,712,161 | * | 12/1987 | Pryor et al. . |
| 4,729,315 | | 3/1988 | Proffitt et al. . |
| 4,760,795 | | 8/1988 | Young . |
| 4,869,170 | | 9/1989 | Dahmberg et al. . |
| 4,924,774 | | 5/1990 | Lenzen . |
| 4,944,224 | * | 7/1990 | Fiedler et al. . |
| 5,029,529 | | 7/1991 | Mandigo et al. . |
| 5,140,906 | | 8/1992 | Little, II . |
| 5,230,287 | | 7/1993 | Arrell, Jr. et al. . |
| 5,447,103 | * | 9/1995 | McIlroy . |
| 5,544,585 | * | 8/1996 | Duguet . |
| 5,563,366 | * | 10/1996 | La Mura et al. . |
| 5,602,360 | * | 2/1997 | Sakamoto et al. . |
| 5,602,713 | * | 2/1997 | Kurogi et al. . |
| 5,621,184 | * | 4/1997 | Gwynn, III . |
| 5,732,634 | * | 3/1998 | Flickinger et al. . |
| 5,912,427 | * | 6/1999 | Willis et al. . |
| 5,912,428 | * | 6/1999 | Patti . |
| 5,939,660 | * | 8/1999 | Fogle, Jr. . |
| 5,992,326 | * | 11/1999 | Martinez-Tovar et al. . |
| 6,078,123 | * | 6/2000 | Tanaka et al. . |
| 6,104,143 | * | 8/2000 | Bonavia . |
| 6,158,347 | * | 12/2000 | Neyer et al. . |

FOREIGN PATENT DOCUMENTS

WO 94/19661 9/1994 (WO) ..... F42C/19/12

* cited by examiner

*Primary Examiner*—Michael J. Carone
*Assistant Examiner*—Troy Chambers
(74) *Attorney, Agent, or Firm*—Zarley, McKee, Thomte, Voorhees & Sease

(57) ABSTRACT

An device for use in an electro-pyrotechnic initiator comprises a header, a foil resistive strip, a substrate, and a current source. The substrate is mounted on the header. The foil resistive strip is mounted on the substrate. The energy source is connected to the resistive strip. When current flows through the resistive strip, the resistive strip generates enough heat to spark autoignition of a pyrotechnic material. The pyrotechnic material is in direct contact with the resistive strip. For an energy input of up to 115 microjoules, the resistive strip can cause autoignition in less than 25 microseconds. In a second embodiment, an electro-pyrotechnic initiator for use in a "smart" airbag system comprises a header, a foil resistive strip, a substrate, a current source connected to the resistive strip, and a control circuit. The control circuit is designed such that it will cause current to flow through the resistive strip when the circuit receives an appropriate signal. A ceramic capacitor can be used as an energy source for the resistive strip.

28 Claims, 5 Drawing Sheets

ELECTRO-PYROTECHNIC INITIATOR

BACKGROUND OF THE INVENTION

1. Field of the Invention

The present invention relates to an electro-pyrotechnic initiator. More specifically, the present invention relates to a device that utilizes a foil resistive element to generate heat and utilizes the heat produced to achieve autoignition temperature in an energetic or pyrotechnic material.

2. Problems in the Art

Electro-pyrotechnic initiators are known in the art. These types of initiators, which are used in variety of settings such as military and air bag applications, suffer from a variety of deficiencies. For example, prior art initiators either require a relatively large amount of energy to initiate autoignition or become more costly with less reliability when reduced to low energy activation levels. In this specification, autoignition temperature is the temperature at which a sample either deflagrates or detonates (in an energetic material), or rapidly combusts or decomposes to release gas, heat, or light (in a pyrotechnic material), under contact heating conditions or by heat of sublimation generated by the heating element. In one such prior art device, known as bridgewire technology, reducing the energy level requires using an electrically conductive wire of such narrow diameter that variations in contact point result in large variations in resistance; parts are more difficult and costly to produce; and the wire elements are more susceptive to damage, thereby reducing reliability. In addition, prior art initiators often utilize multiple levels of successively more sensitive energetic or pyrotechnic materials, adding to the overall cost of the initiator. Finally, variance in the resistivity of the resistive element from the beginning to the end of the manufacturing process leads to unreliability in prior art initiators.

One commonly used method for implementing an electro-pyrotechnic initiator is known as the bridgewire technology, wherein the bridgewire is welded between two contact points. An energetic or pyrotechnic material is compacted against the wire using pressures reaching in excess of 10,000 pounds per square inch. The wire is stretched flat against the very uniform coplanar surfaces of the header, the glass insulator, and the top of the pin, to support the very delicate wire against the high compression forces of the compacted material. Therefore, the bridgewire technology requires the header to be lapped or ground flat. The grinding of the header adds cost to the electro-pyrotechnic initiator. In addition, the bridgewire technology requires costly equipment to orient the product to achieve the precise welding positions that are necessary to get the correct resistance value. Furthermore, the bridgewire technology has two zones of potential electrostatic discharge that could either produce an electric arc or make an electrical contact which would reduce the effective resistance of the bridgewire, making it responsive to an activation energy lower than the designed autoignition energy which would result in accidental firing of the device at electrostatic discharge energies lower than their designed safety levels. The accidental firing of the initiator would expose vehicle occupants or mechanics to unnecessary danger.

To increase the safety of automobiles, automobile manufacturers are increasing the number of air bags within the vehicle. The proliferation of air bags increases the energy reserve requirements needed to fire the air bags. The energy reserve is normally stored as voltage on charged capacitors. The energy storage capacity is directly proportional to the electrical capacitance of the capacitor. Occupant safety systems on contemporary vehicles require relatively high capacitance, which adds to both size and cost. In general, electrolytic capacitors are used for energy storage in contemporary systems. Lower cost ceramic capacitors do not have the capability to store the relatively high energy required to activate contemporary systems. Therefore, a lower energy initiator is needed to reduce the total activation energy reserve needed for the system.

The addition of multiple autoignition-deployed safety devices such as airbags, seatbelt pretensioners, battery cable disconnects, fuel line shut off devices, roll bars, etc. in automobiles also requires the use of "smart" air bag systems. These smart air bag systems use an application specific integrated circuit (ASIC) to receive control signals and control the firing of the initiator. Much of the area of the ASIC is devoted to handling current, while only a small part of the area of the ASIC is devoted to the control signals. The energy requirements of the prior art devices require the ASIC to have a larger size to handle the current requirements. A lower energy device would decrease the size of the ASIC and decrease the overall cost of the system.

An electro-pyrotechnic initiator is generally disclosed in U.S. Pat. No. 5,544,585. This device discloses a foil resistive element to which a thermosensitive substance is coated in the form of an explosive varnish. The heat generated by the resistive element ignites the explosive varnish which in turn fire a primary charge. Adding an explosive varnish to the resistive element increases the cost of the initiator.

In addition, the initiator disclosed in U.S. Pat. No. 5,544,585 requires a relatively large amount of energy in order to ignite the explosive varnish. To fire this initiator using a capacitor, a relatively expensive electrolytic capacitor must be used in order to obtain the capacitance needed to store enough energy. The electro-pyrotechnic initiator of the present invention operates in a lower energy area and does not require the use of an explosive varnish in order to detonate a primary charge. Due to its low energy requirements, a cheaper ceramic capacitor can be used to fire the electro-pyrotechnic initiator of the present invention. In addition, the electro-pyrotechnic initiator of the present invention, for the same input, can achieve higher temperatures than the initiator disclosed in U.S. Pat. No. 5,544,585. In other words, the initiator of the present invention requires less energy to achieve the same temperature response obtainable by the prior art initiator.

FEATURES OF THE INVENTION

A primary feature of the present invention is an electro-pyrotechnic initiator that solves problems and deficiencies in the art.

Another feature of the present invention is an electro-pyrotechnic initiator that can be fired using a low capacitance ceramic capacitor of smaller size and lower cost.

Another feature of the present invention is the provision of electro-pyrotechnic initiator the ignition of which is substantially independent of the substrate to which the resistive element is bonded.

Another feature of the present invention is an electro-pyrotechnic initiator that does not need a primer charge to initiate autoignition.

Yet another feature of the present invention is an electro-pyrotechnic initiator that requires less energy than prior art initiators to produce the same temperature change. Moreover, the present invention will achieve the same temperature faster or, conversely, it will achieve a higher temperature with the same energy.

These and other features of the invention will be apparent from the following detailed description and claims taken in conjunction with the accompanying drawings.

SUMMARY OF THE INVENTION

A device for use in an electro-pyrotechnic initiator comprises a header, a foil resistive strip, a substrate, and an energy source. The substrate is mounted on the header. The foil resistive strip is mounted on the substrate. The energy source is connected to the resistive strip. The energy source may be external to the device. When current flows through the resistive strip, the resistive strip generates enough heat to achieve autoignition in a pyrotechnic material.

In a second embodiment, an electro-pyrotechnic initiator comprises a header, a foil resistive strip, a substrate, a thermal delay insulating material between the resistive strip and the substrate, a energy source, an energetic or pyrotechnic material, and an enclosure cap around the header. The substrate is mounted on the header. The foil resistive strip is mounted on the substrate. The energy source is connected to the resistive strip. The energetic material is placed in contact with, or in close proximity to, the resistive strip. A cap is attached to enclose the surface of the header and all other elements, although the current source may be external to the device. When current flows through the resistive strip, the resistive strip generates enough heat to achieve autoignition.

In a third embodiment, an electro-pyrotechnic initiator for use in a "smart" airbag system comprises a header, a foil resistive strip, a substrate, an energy source connected to the resistive strip, and a control circuit. The control circuit is designed such that it will cause current to flow through the resistive strip when the circuit receives an appropriate signal. The activation energy is low enough that a small, low cost ceramic capacitor can be used as a current source for the resistive strip.

DETAILED DESCRIPTION OF EXEMPLARY EMBODIMENTS

Figure 1:
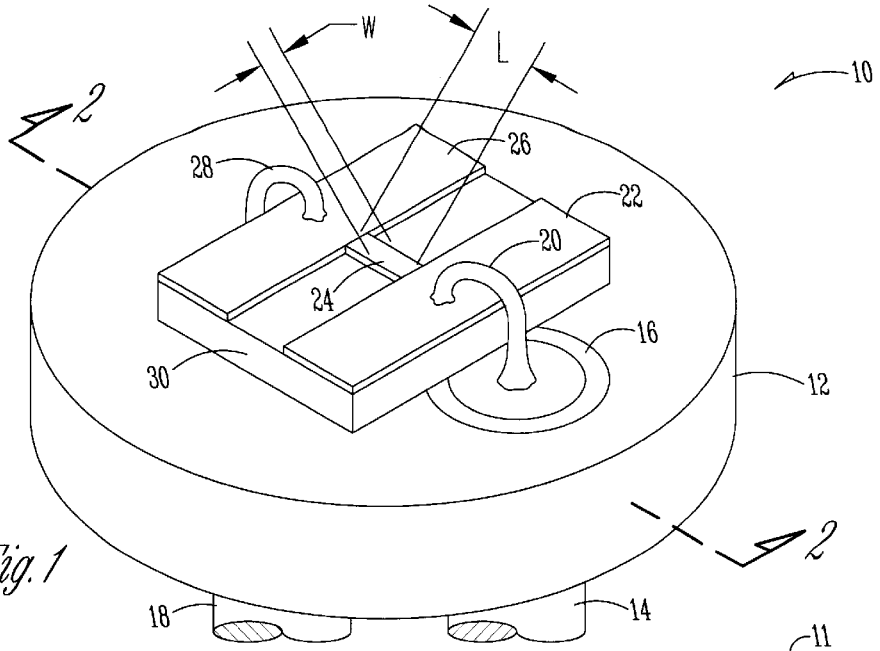
FIG. 1 is a perspective view of an electro-pyrotechnic initiator according to the present invention, shown without a cap.

The present invention is discussed with reference to airbag applications. However, this discussion implies no limitation as to the setting in which the electro-pyrotechnic initiator could be used. It is understood that the present invention can be used in military applications, inflatable restraints, explosive bolts and shearing devices, pilot seat ejection systems, and any other context in which an electro-pyrotechnic initiator could be used.

An electro-pyrotechnic initiator according to the present invention is generally referenced by the numeral 10. The electro-pyrotechnic initiator 10 includes a header 12. A first pin 14 extends through the header 12. The first pin 14 is surrounded by a glass layer 16 which electrically isolates the first pin 14 from the header 12. A second pin 18 is electrically connected to the header 12. A cap 11 (FIG. 2) encompasses or encloses the header 12. Within the cap 11, an energetic or pyrotechnic material is held in close proximity to, or in contact with, the resistive strip 24. As is understood in the art, the cap 11 has a frangible wall that is designed to rupture under pressure, channeling the heat energy into a larger energetic pyrotechnic charge to initiate a volatile response. Although a cap is not shown in the embodiments of FIGS. 3–6, it is understood that a cap could be used with these embodiments. The electronic components, without the cap or explosive material in the cap, are referred to as a device for use in an electro-pyrotechnic initiator.

The first pin 14 is electrically connected to a bonding pad 22 through a standard wire bond 20. A resistive strip 24 is electrically connected to the first conduction area or bonding pad 22. The resistive strip 24 is a foil resistor. The foil resistor is comprised of a metal of known thickness, known density, known specific heat, commonly an alloy of nickel and chromium plus trace elements. Other alloys, for example, nickel-copper or tungsten-platinum could be used. The foil resistor is used to control both the thermal and resistive properties of the resistive strip 24. The foil resistor pattern on the resistive strip 24 can be changed as desired for maximum electro-pyrotechnic efficiency without imposing any change in the initiator manufacturer's assembly process. Patterns on the foil resistor can be configured for thermal management to allow for non-volatilizing, oxygenating, particles within the pyrotechnic mix, or to control the no-fire conditions. The resistance of the foil resistive strip 24 does not vary when the electro-pyrotechnic initiator 10 is manufactured.

The resistive strip 24 has a length, L, a width, W, and a thickness, T. These dimensions can be varied to control the resistance of the resistive strip 24, the response time needed to reach a desired temperature, and the input current (or energy) needed to cause the desired temperature change. By varying the length, width, and thickness of the foil resistor 24, the electro-pyrotechnic initiator 10 can be highly controlled. The width, W, of the resistive strip 24 is a function of the desired temperature change, the response time of the temperature change, and the current that will be input into the resistive strip. In addition, the width, W, is dependent on the thickness of the foil, the specific heat of the foil, and the density of the foil. The length, L, is dependent on the width, W, the desired resistance of the resistive strip 24, and the resistivity of the foil. The resistive strip will preferably have a length of 100–3000 micrometers, a thickness of 1.5–10 micrometers, and a width of less than 80 micrometers. The resistive strip 24 is designed such that for a given thickness, T, the length, L, and the width, W, can be altered based on the desired characteristics of the electro-pyrotechnic initiator 10.

The resistive strip 24 is also electrically connected to a second conduction area or bonding pad 26. The second bonding pad 26 is electrically connected to the header 12 through a standard wire bond 28. The resistive strip 24 and both bonding pads 22, 26, are mounted on a ceramic substrate 30. The resistive strip 24 is attached to the ceramic substrate by a thermal-delay bonding adhesive, such as epoxy. A thermal-delay material is one that has a slow thermal response so as to not bleed much heat away from the resistive strip. While it is not necessary to use a thermal-delay adhesive, doing so ensures that much of the heat generated by the resistive strip 24 is used to achieve autoignition of the energetic or pyrotechnic material. A thermal-delay adhesive prevents the heat generated by the resistive strip 24 from being "pulled away" by the ceramic substrate 30. The bonding pads 22, 26, are secured to the ceramic substrate 30 by methods commonly known in the art. The ceramic substrate 30 is secured to the header 12 through methods commonly known in the art. For an activation current of two amps and a resistance of five ohms, the temperature of the resistive strip can increase 1300° C. in a time period of 15 microseconds for a specific width and thickness of foil, dimensions of which are within the scope of this patent.

In practice, an explosive such as zirconium potassium perchlorate (ZPP) may be compacted against the resistive strip 24. Input current flows through the first pin 14, through wire 20, through the resistive strip 24 and out through the second wire bond 28. The header 12 is grounded through the second pin 18. As the current flows through the resistive strip 24, the resistive strip 24 will heat up very quickly causing the ZPP to ignite. While some prior art devices teach the use of a primer charge to explode the ZPP, the resistive strip 24 reaches temperature extremes fast enough so as to eliminate the need for intermediate energetic or pyrotechnic responses. This is advantageous because in many instances lead styphnate is used as the primer charge. The lead products that are generated by the firing of lead styphnate are a health hazard to the workers who must test the pyrotechnic device and, therefore, experience health risks due to repeated exposure to lead. The present invention eliminates this potential health hazard.

Figure 2:
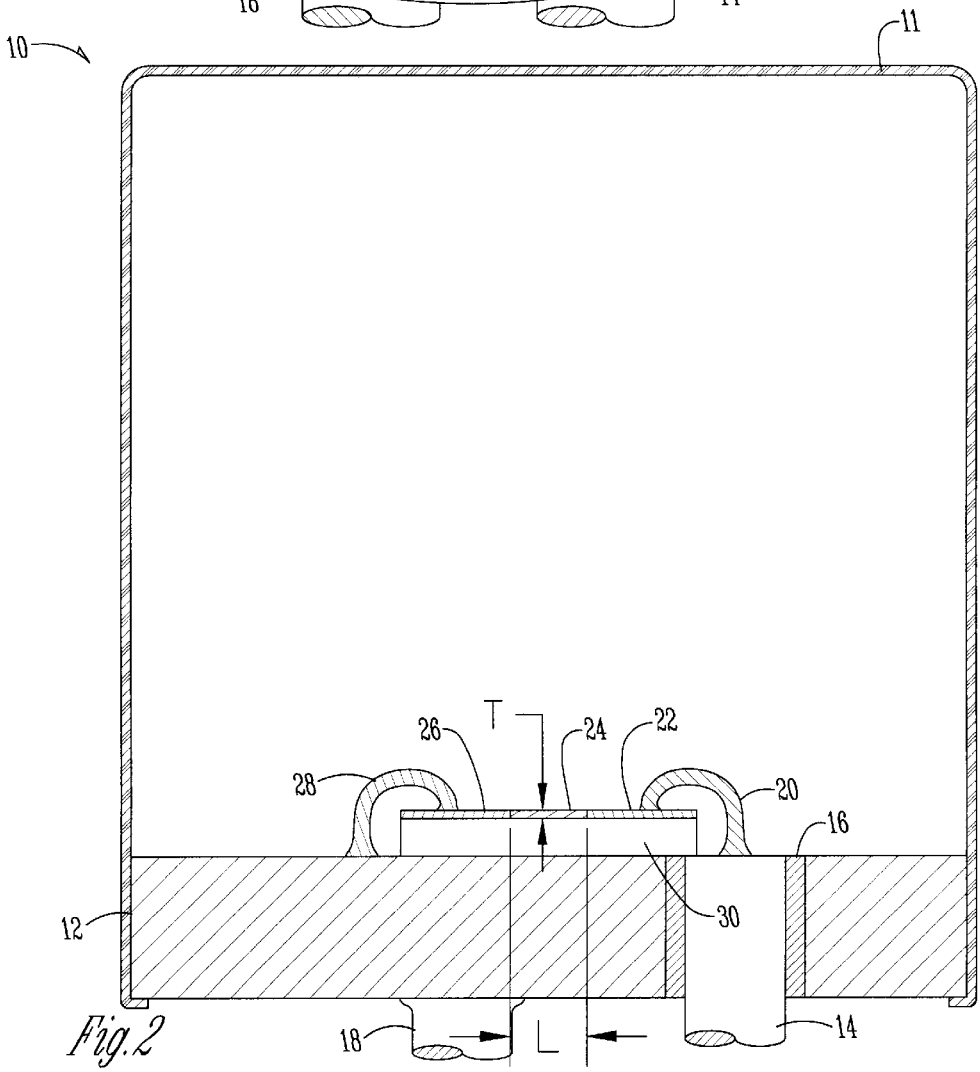
FIG. 2 is a cross-sectional view taken along line 2—2 of FIG. 1, shown with an enclosure cap.
Figure 3:
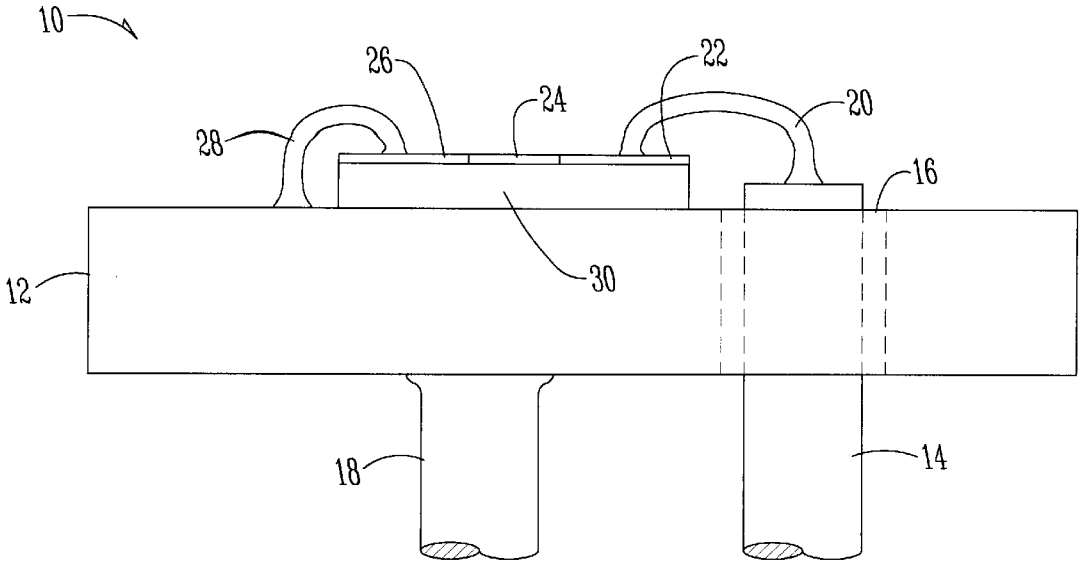
FIG. 3 is a side elevation of a second embodiment of the present invention, shown with the pin extending above the header.

A second embodiment of the present invention is shown in FIG. 3. The only difference between the device in FIG. 3 and that of FIGS. 1–2 is that the first pin 14 extends above the header 12. In the bridgewire technique of the prior art, the top of pin 14 and the surface of glass insulator 16 had to be co-planar with the header 12. The present invention eliminates the need to make the top of the pin and the glass insulator co-planar with the header, greatly reducing the cost to make the electro-pyrotechnic initiator.

Figure 4:
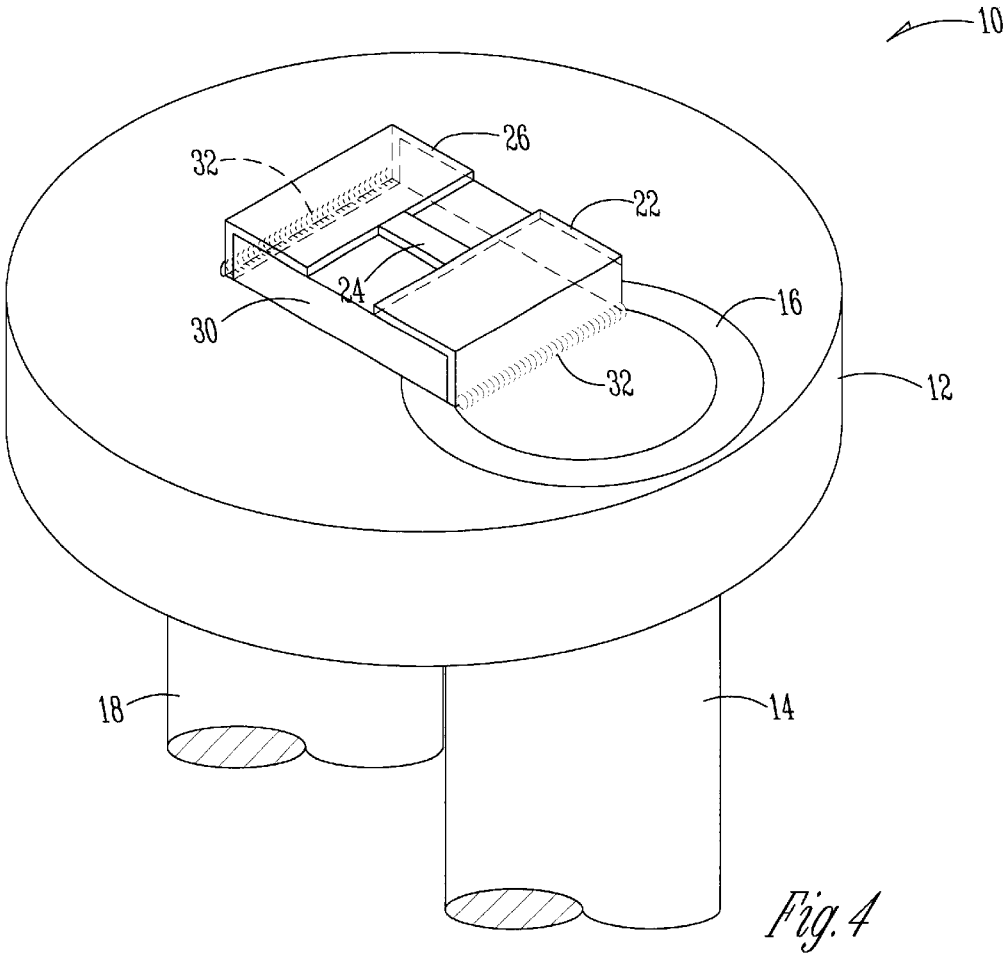
FIG. 4 is a front view of a third embodiment according to the present invention, showing a surface mount version.

FIG. 4 is also very similar to FIGS. 1–3. The only difference is that rather than a standard wire bond, solder 32 is used to electrically connect the bonding pads to the first pin 14 and to the header 12. FIG. 4 shows that the surface mounted foil-resistive strip 24 can be mounted directly to a header 12 that may presently be used for a bridgewire element. There is no retooling required.

Figure 5:
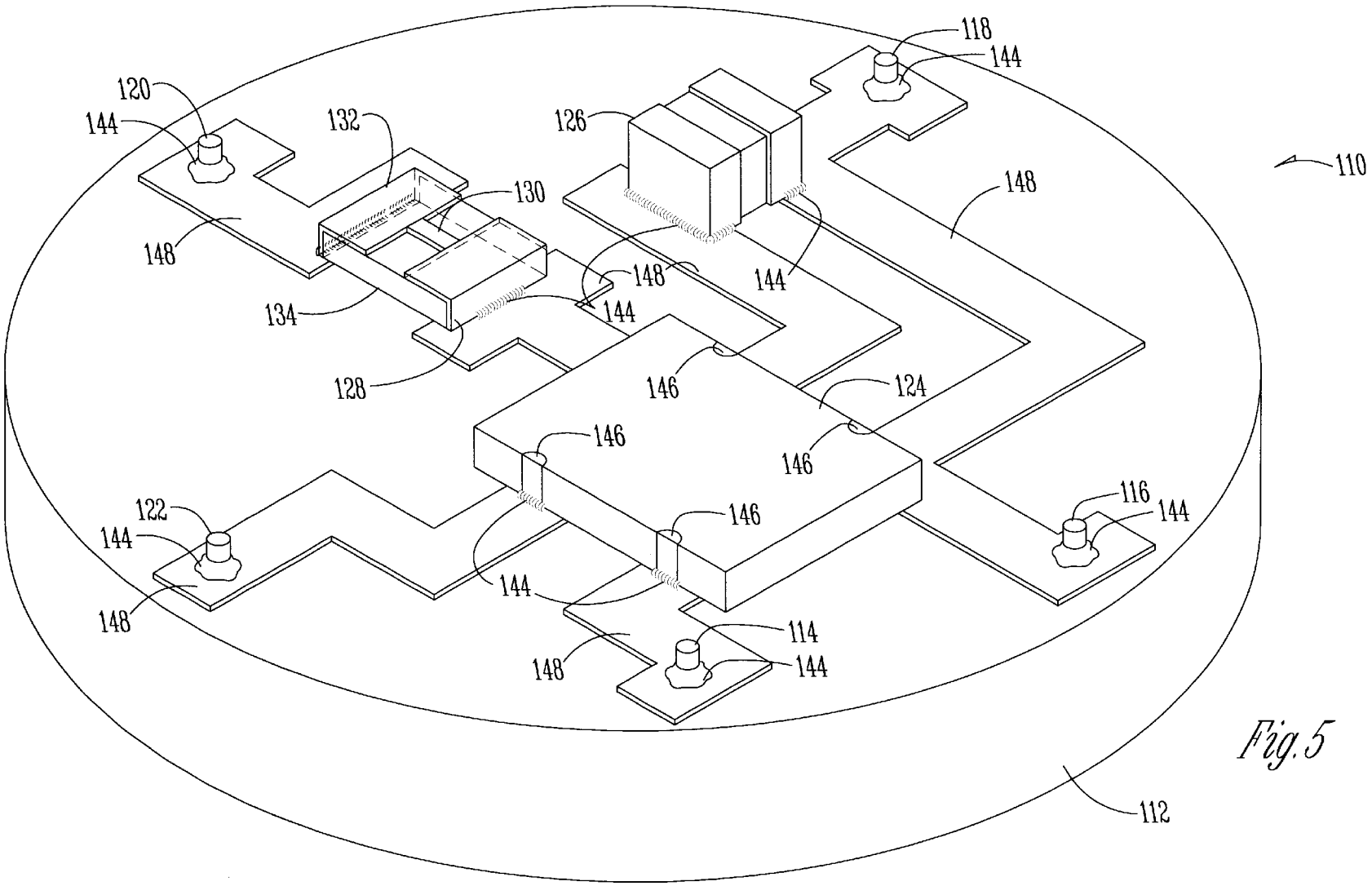
FIG. 5 is a fourth embodiment according to the present invention, showing the electro-pyrotechnic initiator in conjunction with a ceramic capacitor and an ASIC.

FIG. 5 shows a fourth embodiment according to the present invention. The electro-pyrotechnic initiator 110 of FIG. 5 can be used in a smart air bag system. The header 112 is preferably metal. Solder 144 electrically connects the pins 114, 116, 118, 120, 122 and the surface mounted elements 124, 126, 134, to conduction areas 148. These connections could equally well be made via bonding wires as in the example in FIG. 1. An application specific integrated circuit (ASIC) 124 is mounted on the header 112. The ASIC 124 receives control signals from a microprocessor (not shown). Of course, instead of mounting all of the components on a header, they could be mounted on circuit board material which could be mounted on the header 112. The ASIC 124 has a number of inputs 146. It should be noted that the connections between the pins 114, 116, 118, 120, and 122 and the ASIC 124 inputs 146 are not important for the purposes of this specification. Rather, FIG. 5 is meant to illustrate that the electro-pyrotechnic initiator according to the present invention can be used in a "smart" airbag system.

Based on the control signal received from the microprocessor, the ASIC 124 will control charging of the capacitor 126, and discharging of the capacitor through the resistive strip 130. The resistive strip 130 is preferably a foil resistor. The resistive strip 130 is mounted on a ceramic substrate 134. Once again, preferably a thermal-delay bonding adhesive is used to attach the resistive strip 130 to the ceramic substrate 134. For some applications, particularly military applications, the capacitor may also have a timing input to "instruct" the capacitor 126 to discharge after a given time period.

When the electro-pyrotechnic initiator 110 is used in automobiles, it is desirable that the dielectric of the capacitor 126 is an X7R or higher K factor dielectric material. Currently, the X7R dielectric is the minimum performance dielectric that will supply the correct amount of energy at the high operating temperature (105° C.) of the auto industry. The lower energy requirements of the resistive strip 130 allow for the use of an X7R dielectric. Prior art initiators could not use an X7R dielectric due to their higher capacitance requirements. In addition, a ceramic capacitor 126 can be used due to the need for lower capacitance. Prior art initiators used electrolytic capacitors due to the capacitance required to deliver enough energy to their resistive elements.

When the ASIC 124 receives the proper signal from the microprocessor, the charged capacitor 126 will discharge through the first conduction area or bonding pad 128, through the resistive strip 130, and out through the second bonding pad 132. The resistive strip 130 will heat up, firing an energetic or pyrotechnic charge such as ZPP, which is in contact with, or close proximity to, the resistive strip 130.

There may be many of the devices shown in FIG. 5 connected to the same electrical bus (not shown) to drive multiple electro-pyrotechnically deployed safety devices, including airbags, seatbelt pretensioners, battery cable and fuel line disengagers, etc. The ASIC 124 will need to be designed so as to distinguish control signals from the microprocessor. That way, the electro-pyrotechnic initiator 110 will not fire unless needed, conserving initiators, saving money, and reducing unnecessary risk to vehicle occupants.

As an example, a ceramic capacitor having a capacitance of 0.47 microfarads and charged to 20 volts (94 microjoules of energy) could deliver the activation energy required to increase the temperature of the resistive strip 130 by 1000° C. The resistive strip 130 could have a length, L, of 280 micrometers, a width, W, of 28 micrometers, and a thickness, T, of 2.5 micrometers. A resistive strip 130 with these dimensions would have a resistance of 5 ohms. The resistive strip 130 would increase temperature by 1000° C. when only 78.8 microjoules of energy (83.8% of the total) had been delivered to the resistive strip. This would occur in less than 5 microseconds, two resistor-capacitor time constants equal to 4.7 microseconds being required to deliver 86.5% of the energy stored on the capacitor. Of course, when an energetic or pyrotechnic is in close proximity to the resistive strip 130, the temperature of the resistive strip 130 will not increase as greatly because some of the heat will be absorbed by the pyrotechnic.

As a second example, an input current of 1.5 amps could be applied for 20 microseconds into a resistive strip having a cross-sectional area of $124.5\times10^{-8}$ square centimeters. The temperature of the resistive strip 130 would increase by 900° C. in those 20 microseconds. Once a temperature response is known for a given current applied for a given duration (or a given energy input), the temperature response of the resistive strip 130 can be tuned by changing the cross-sectional area of the strip 130 such that $$\Delta T_1[A_1/A_2]^2=\Delta T_2$$

wherein $\Delta T_1$ is the temperature change for the a given current input and duration, $A_1$ is the first cross-sectional area, $\Delta T_2$ is the temperature change for the same current input and duration, and $A_2$ is the second cross-sectional area.

Figure 6:
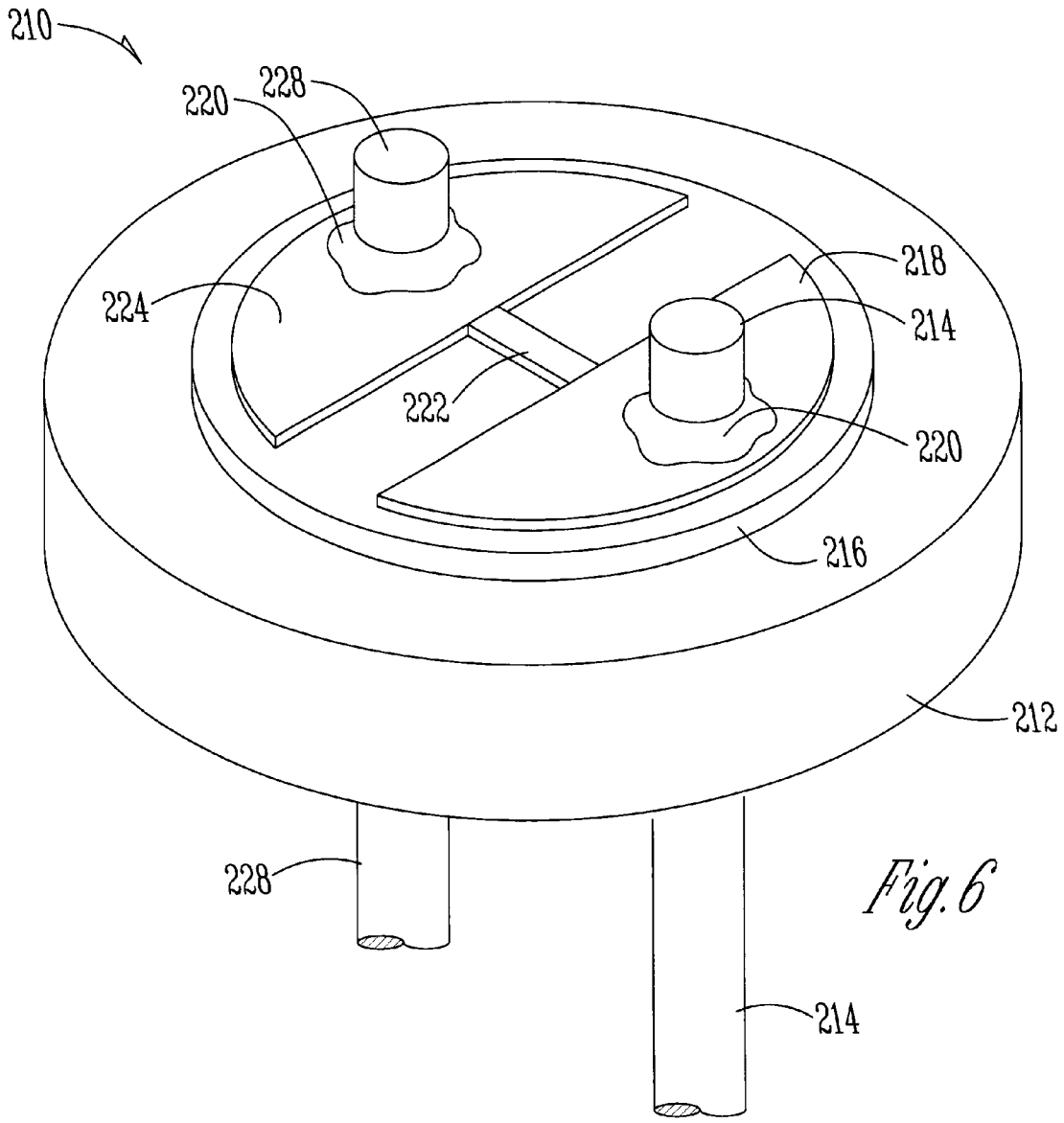
FIG. 6 is a perspective view of a fifth embodiment according to the present invention, shown with an epoxy glass or polyimid substrate.

A fifth embodiment according to the present invention is shown in FIG. 6. The electro-pyrotechnic initiator 210 has a header 212. A first pin 214 runs through the header. The first pin 214 is the electrically isolated from the header 212 by a glass collar similar to item 16 in FIG. 1. The supporting substrate 216 for resistive strip 222 and its terminating end pads 218 and 224 is an insulating material such as epoxy-glass or polyimid. The first pin 214 is electrically coupled to a first solder pad or conduction area 218 by a fillet of solder 220. The first solder pad is electrically connected to the activating resistive strip 222. The resistive strip 222 is a foil resistor. The resistive strip 222 is electrically connected to a second solder pad 224. The second solder pad 224 is electrically connected to a second pin 228 through a fillet of solder 220. The second pin 228 is also electrically isolated from the header 112 by a collar of insulating glass similar to item 16 in FIG. 1. In some cases one of these pins may be electrically connected to the header by eliminating the insulating collar. The solder pads 218, 224 and the resistive strip 222 are mounted on the insulating substrate 216 by standard methods. Once again, in the embodiment shown in FIG. 6, the surface of the header 212 does not have to be co-planar with the tops of pins 214 and 228. This results in a considerable cost savings.

Figure 7:
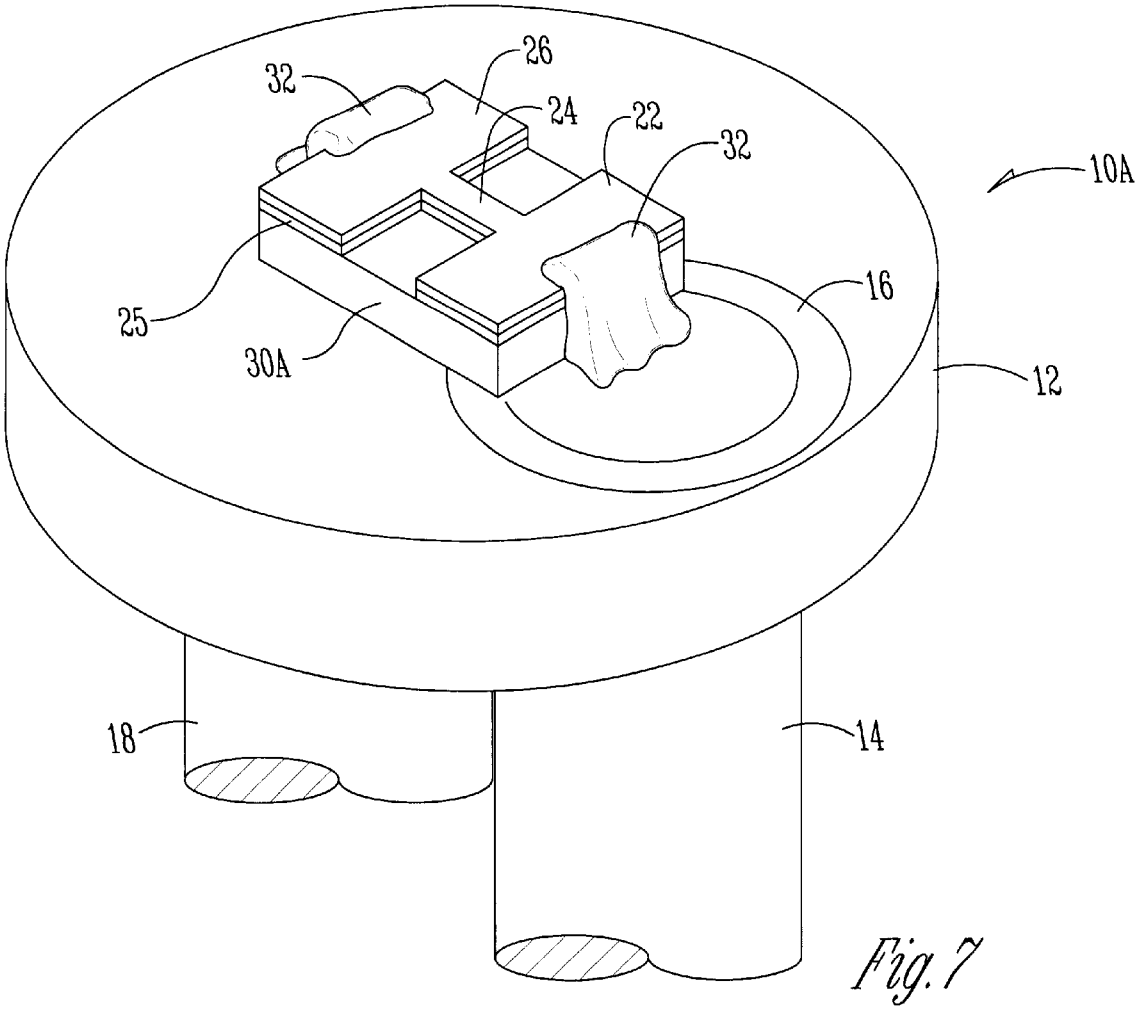
FIG. 7 is a perspective view of a sixth embodiment of the electro-pyrotechnic initiator.

FIG. 7 shows a perspective view of a sixth embodiment of an electro-pyrotechnic initiator 10A according to the present invention. In this embodiment, a fillet of solder 32 is used to provide a conductive bridge between the bonding or termination pads 22, 26 and pin 14 and header 12, respectively. A conductive epoxy could be used in place of solder 32. Resistive strip 24 and the termination pads 22, 26 are attached to a polyimide substrate 30A via a thermal delay bonding adhesive 25. The embodiment in FIG. 7 functions in substantially the same manner as the previously discussed embodiments. However, the use of polyimide as a substrate provides some additional benefits.

When ceramic is used as a substrate (as in FIG. 4), care must be exercised to assure that the ceramic substrate is appropriately supported by the header to prevent problems when a pyrotechnic material is later compacted against the resistive strip. For example, if the ceramic chip is not held firmly against the header while the chip is being attached to the header, reflowing solder could be drawn under the ends of the chip, thereby raising the ceramic chip a few milli-inches above the surface of the header. This can result in the ceramic chip being suspended above the header, held in that position by the re-solidified solder beneath the chip at each end of the chip. When the pyrotechnic is compacted agains the resistive strip, usually at pressures exceeding 10,000 pounds per square inch, the unsupported rigid ceramic chip will often crack. This can be avoided by using proper care during the attachment process. It could also be prevented by attaching the ceramic chip using standard industry die attachment processes which place the additional support of an epoxy platform beneath the middle of the chip. However, each of thes precautions has some associated costs in their implementations. The embodiment of FIG. 7, which uses a flexible polyimide substrate, eliminates the cracking problem without the additional cost.

In the embodiment of FIG. 7, the resistive strip 24 is directly attached to a thin layer of flexible material such as polyimide 30A, or other flexible materials such as epoxy, kapatan, or other plastic material. The polyimide substrate 30A has a thickness of 0.3 milli-inches or greater, and has the flexibility to adjust itself to the surface of the header even if the header is not precisely flat or if the substrate 30A is not in direct contact with the header beneath it. Thus, when the pyrotechnic is compressed against the resistive strip 24, the polyimide substrate 30A yields to the pressure and conforms to the surface of the header beneath it, without risk of damage such as the cracking that might be experienced with a rigid substrate. The electrical connections are then made by either solder 32 or conductive epoxy which is applied so as to bridge between the electrical contact pads 22, 26 to the appropriate connection pads located on the header or other circuit support. This embodiment produces an attached bridge resistor at lower cost and higher reliability than the other embodiments.

From the foregoing, it can be seen that the present invention possesses all of the stated features.

I claim:

1. A device for use in an electro-pyrotechnic initiator, comprising:

a foil resistive strip;

a substrate, the resistive strip cemented to the substrate;

an energy source operatively connected to the resistive strip;

a header, the substrate being mounted on the header; and a pyrotechnic main charge material in direct contact with the resistive strip, the resistive strip having a width of less than about 80 micrometers and dimensions so that an energy input of up to 115 microjoules into the resistive strip will cause the resistive strip to generate sufficient heat to cause the pyrotechnic material to achieve autoignition in 25 microseconds or less.

2. The device of claim 1 wherein the energy source is a current source and the energy input is a current of up to 1.5 amps.

3. The device of claim 1 wherein the energy source is a capacitor.

4. The device of claim 3 wherein the capacitor is a ceramic capacitor.

5. The device of claim 4 wherein a dielectric of the ceramic capacitor has a K factor of X7R material or higher.

6. The device of claim 1 wherein a thermal-delay bonding adhesive attaches the resistive strip to the substrate.

7. The device of claim 1 wherein the foil resistive strip is a nickel chromium alloy.

8. The device of claim 1 wherein the substrate is ceramic.

9. The device of claim 1 wherein the substrate is polyimid.

10. The device of claim 1 wherein the substrate is epoxy glass.

11. An electro-pyrotechnic initiator, comprising:

a foil resistive strip;

a substrate, the foil resistive strip attached to the substrate with a thermal-delay bonding adhesive;

an energy source operatively connected to the resistive strip;

an energetic or pyrotechnic main charge material in direct contact with the resistive strip, the resistive strip having a width of less than about 80 micrometers and dimensions so that an energy input of up to 115 microjoules into the resistive strip will cause the resistive strip to generate sufficient heat to cause the pyrotechnic material to achieve autoignition in 25 microseconds or less;

a header, the substrate being mounted on the header; and an enclosure cap around the header.

12. The electro-pyrotechnic initiator of claim 11 wherein the energy source is a current source and the energy input is a current of up to 1.5 amps.

13. The electro-pyrotechnic initiator of claim 11 wherein the energy source is a capacitor.

14. The electro-pyrotechnic initiator of claim 13 wherein the capacitor is a ceramic capacitor.

15. The electro-pyrotechnic initiator of claim 14 wherein the capacitance of the capacitor is no greater than 3 microfarads.

16. The electro-pyrotechnic initiator of claim 15 wherein a dielectric of the ceramic capacitor has a K factor of X7R material or higher.

17. The electro-pyrotechnic initiator of claim 11 wherein a width of the resistive strip is less than 70 micrometers.

18. The electro-pyrotechnic initiator of claim 11 wherein a length of the resistive strip is no greater than 3000 micrometers.

19. The electro-pyrotechnic initiator of claim 11 wherein the resistive strip is a nickel chromium alloy.

20. An electro-pyrotechnic initiator for use in a smart air bag system, comprising:

a header;

a substrate mounted either directly on the header or onto an intermediate circuit substrate which is mounted on the header;

a foil resistive strip attached to the substrate with thermal-delay bonding adhesive;

an energy source operatively connected to the foil resistive strip;

a circuit designed to receive control signals and cause the current source to send current through the foil resistive strip in response to the control signals;

an energetic or pyrotechnic main charge material in contact with the resistive strip, the resistive strip having a width of less than about 80 micrometers and dimensions so that an energy input of up to 115 microjoules into the resistive strip will cause the resistive strip to generate sufficient heat to cause the pyrotechnic material to achieve autoignition in 25 microseconds or less a width of less than 80 micrometers and a length of less than 3000 micrometers; and an enclosure cap around the header.

21. The electro-pyrotechnic initiator of claim 20 wherein the energy source is a ceramic capacitor and the circuit controls discharging of the capacitor through the resistive strip.

22. The electro-pyrotechnic initiator of claim 21 wherein the capacitance of the ceramic capacitor is no greater than 3 microfarads.

23. The electro-pyrotechnic initiator of claim 21 wherein a dielectric of the capacitor has a K factor of X7R material or higher.

24. The electro-pyrotechnic initiator of claim 20 wherein the resistive strip is a nickel chromium alloy.

25. The electro-pyrotechnic initiator of claim 24 wherein the width of the resistive strip is less than 70 micrometers.

26. The electro-pyrotechnic initiator of claim 20 wherein a length of the resistive strip is less than 3000 micrometers.

27. The electro-pyrotechnic initiator of claim 20 wherein a thickness of the resistive strip is between about 1.5 micrometers and 10 micrometers.

28. A device for use in an electro-pyrotechnic initiator, comprising:

a foil resistive strip;

a polyimid substrate, the resistive strip cemented to the substrate;

an energy source operatively connected to the resistive strip;

a header, the polyimid substrate being mounted on the header; and a pyrotechnic material in direct contact with the resistive strip, the resistive strip having dimensions so that an energy input of up to 115 microjoules into the resistive strip will cause the resistive strip to generate sufficient heat to cause the pyrotechnic material to achieve autoignition in 25 microseconds or less.

* * * * *